US007929001B2

(12) United States Patent
Bae et al.

(10) Patent No.: US 7,929,001 B2
(45) Date of Patent: Apr. 19, 2011

(54) DISPLAY DEVICE AND CONTROL METHODS THEREFOR

(75) Inventors: Jae-sung Bae, Cheonan-si (KR); Jun-pyo Lee, Cheonan-si (KR); Jin-ho Park, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 838 days.

(21) Appl. No.: 11/872,631

(22) Filed: Oct. 15, 2007

(65) Prior Publication Data

US 2008/0088560 A1 Apr. 17, 2008

(30) Foreign Application Priority Data

Oct. 16, 2006 (KR) ..... 10-2006-0100334

(51) Int. Cl.
*G09G 5/10* (2006.01)

(52) U.S. Cl. ..... 345/692; 345/89

(58) Field of Classification Search ..... 345/87–89, 345/94, 95, 98, 99, 100, 690–692
See application file for complete search history.

(56) References Cited

U.S. PATENT DOCUMENTS

| | | | | |
|---|---|---|---|---|
| 5,615,027 | A * | 3/1997 | Kuribayashi et al. | 349/87 |
| 7,869,115 | B2 * | 1/2011 | Endo et al. | 359/290 |
| 2004/0066363 | A1 * | 4/2004 | Yamano et al. | 345/98 |
| 2006/0139265 | A1 * | 6/2006 | Kimura | 345/77 |
| 2008/0024856 | A1 * | 1/2008 | Ishii et al. | 359/290 |

FOREIGN PATENT DOCUMENTS

| | | |
|---|---|---|
| KR | 1020050062855 | 6/2005 |
| KR | 1020060045276 | 5/2006 |
| KR | 1020060045285 | 5/2006 |

* cited by examiner

*Primary Examiner* — Ricardo L Osorio
(74) *Attorney, Agent, or Firm* — Innovation Counsel LLP

(57) ABSTRACT

A display device, includes: a display panel comprising a plurality of pixels; a signal controller which receives an n+k bit first image signal to divide one frame into $2^k$ number of sub frames and generates a non-image signal according to an upper k most significant bits of the binary code and a second image signal with a lower n bit, of the first image signal in one frame with a predetermined rate; and a data driver which supplies a data voltage selected on the basis of the non-image signal and the second image signal, to the pixels.

21 Claims, 13 Drawing Sheets

DISPLAY DEVICE AND CONTROL METHODS THEREFOR

CROSS-REFERENCE TO RELATED APPLICATIONS

This application claims priority from Korean Patent Application No. 2006-0100334, filed on Oct. 16, 2006 in the Korean Intellectual Property Office, the disclosure of which is incorporated herein by reference.

BACKGROUND OF THE INVENTION

1. Field of the Invention

Apparatus and methods consistent with the present invention relate to a display device and a control method thereof, and more particularly, to a display device which has a data driver to supply a data signal and a control method therefor.

2. Description of the Related Art

A liquid crystal display (LCD) device or an organic light emitting diode display includes a thin film transistor (TFT) on a circuit substrate to independently drive pixels. The thin film transistor substrate has a gate line to transmit a scanning signal and a data line to transmit a data signal. The thin film transistor substrate includes a thin film transistor which is connected with the gate line and the data line or a pixel electrode which is connected with the thin film transistor. Such a display device includes a gate driver to turn on and off the thin film transistor and a data driver to supply gradation voltages corresponding to an image to be displayed.

The number of digital bits of the data driver determines the number of expressible gradations, i.e., the number of levels of the gradation voltage. If the data driver is supplied with n bits, a single color is expressible by $2^n$ levels of gradations while when red, green, and blue colors are to be expressed, $2^{3n}$ levels of gradation are required. The greater number of gradation levels is required to display an image with the greatest fidelity in full color. However, supplying a data driver with a greater number of bits involves high production costs, thereby increasing the price of a display device.

SUMMARY OF THE INVENTION

Accordingly, it is an aspect of the present invention to provide a display device which expresses $2^{n+k}$ levels of gradation by using an n bit data driver and an appropriate control method.

Also, it is another aspect of the present invention to provide a display device which prevents image blurring by applying impulsive driving.

The foregoing and/or other aspects of the present invention can be achieved by providing a display device comprising: a display panel comprising a plurality of pixels; a signal controller which receives an n+k bit binary coded first image signal, divides one frame into $2^k$ sub frames, generates a non-image signal from the upper k most significant bits of the binary coded first image signal and generates a second image signal from the lower n bits of the first image signal in one frame with a predetermined rate; and a data driver which supplies the pixels with a data voltage selected on the basis of the non-image signal and the second image signal.

According to the embodiment of the present invention, the signal controller generates the second image signal in m+1 of the sub frames from the upper k most significant bits of the binary code.

According to the embodiment of the present invention, the signal controller generates the second image signal in $2^k$−m number of sub frames if the decimal value of the upper k most significant bits of the binary code is m.

According to the embodiment of the present invention, a sub frame displaying the non-image signal in one frame is formed prior to a sub frame displaying the second image signal.

According to the embodiment of the present invention, a sub frame displaying the second image signal in one frame is formed prior to a sub frame displaying the non-image signal.

According to the embodiment of the present invention, sub frames displaying the non-image signal are consecutively formed.

According to the embodiment of the present invention, the sub frame displaying the non-image signal is represented in black in the display panel.

According to the embodiment of the present invention, the sub frame displaying the non-image signal is represented in gray in the display panel.

According to the embodiment of the present invention, 60 frames are formed per second.

According to the embodiment of the present invention, the display panel further comprises a first substrate, a second substrate and a liquid crystal layer disposed between the first and second substrates, the liquid crystal layer comprising liquid crystal molecules aligned in an optically compensated birefringent (OCB) mode.

The foregoing and/or other aspects of the present invention can be achieved by a method of controlling a display device, comprising: receiving an n+k bit binary coded first image signal constituting one frame; dividing the one frame into $2^k$ sub frames and generating a non-image signal formed according to the upper k most significant bits of the binary coded first image signal and a second image signal from the lower n bits of the first image signal in one frame with a predetermined repetition rate; forming an image data voltage based on the non-image signal and the second image signal; and forming a plurality of the sub frames for the frame to be displayed and supplying the image data voltage to the pixels.

According to the embodiment of the present invention, the forming of the sub frames comprises generating the second image signal in m+1 number of the sub frames if the decimal value of the upper k most significant bits of the binary code is m.

According to the embodiment of the present invention, the forming of the sub frames comprises generating the second image signal in $2^k$−m number of the sub frames if the decimal value of the upper k most significant bits of the binary code is m.

According to the embodiment of the present invention, the forming of the sub frames comprises forming a sub frame displaying the non-image signal in one frame prior to a sub frame displaying the second image signal.

According to the embodiment of the present invention, the forming of the sub frames comprises forming a sub frame displaying the second image signal in one frame prior to a sub frame displaying the non-image signal.

According to the embodiment of the present invention, the forming of the sub frames comprises forming sub frames displaying the non-image signal consecutively.

According to the embodiment of the present invention, the sub frame displaying the non-image signal is represented in black or gray in the display panel.

According to the embodiment of the present invention, 60 frames are formed per second.

BRIEF DESCRIPTION OF THE DRAWINGS

The above and/or other aspects and advantages of the present invention will become apparent and more readily appreciated from the following description of the embodiments, taken in conjunction with the accompanying drawings, in which.

DETAILED DESCRIPTION OF EMBODIMENTS

Figure 1:
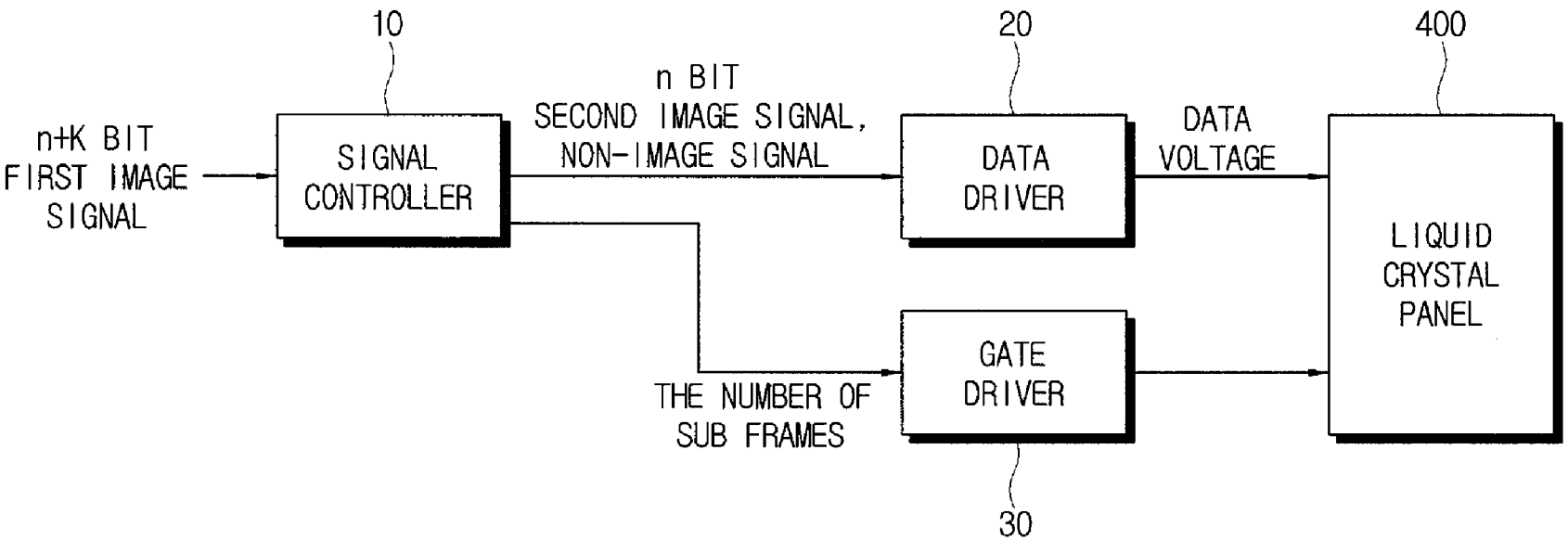
FIG. 1 is a control block diagram of a display device according to a first embodiment of the present invention.

FIG. 1 is a control block diagram of a display device according to a first embodiment of the present invention.

As shown therein, the display device includes a signal controller 10 which receives an n+k bit first image signal and outputs a non-image signal and an n bit second image signal, a data driver 20 which outputs a data voltage according to the non-image signal and the n bit second image signal outputted from the signal controller 10, a gate driver 30 which controls a gate line (to be described later) to form a plurality of sub frames according to the non-image signal and the n bit second image signal outputted from the signal controller 10 and a liquid crystal panel 400 which realizes an image by the signal supplied from the data driver 20 and the gate driver 30. The display device according to the present invention includes a liquid crystal display device having the liquid crystal panel 400, but not limited thereto. Alternatively, the present invention may be applicable to other display devices as long as they have a thin film transistor substrate to form a pixel A, a gate driver 30 and a data driver to drive the thin film transistor substrate. A display device according to another embodiment of the present invention may include an organic light emitting diode (OLED) having an organic light emitting layer.

Figure 2A:
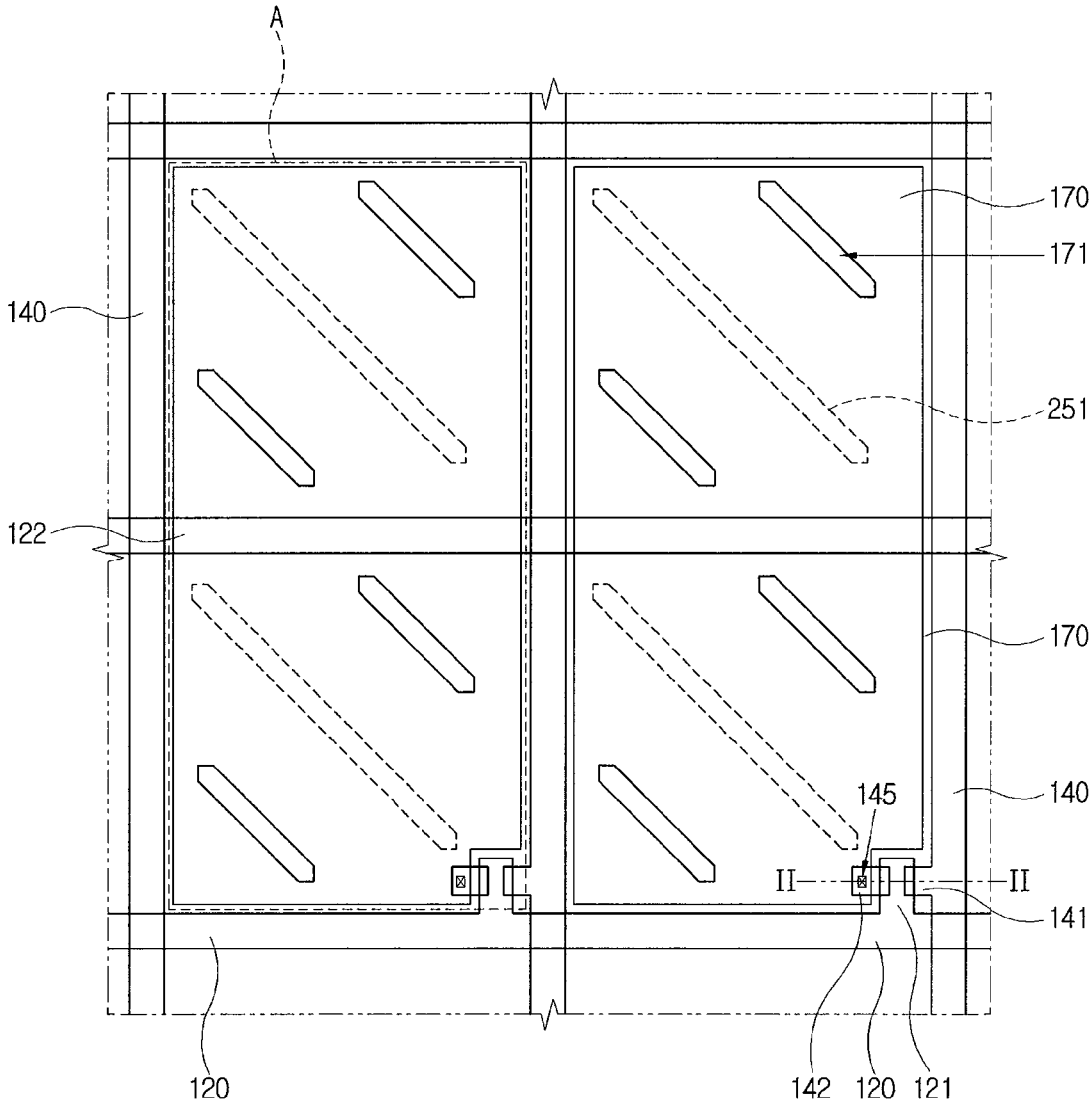
FIG. 2A is a plan view of the display device according to the first embodiment of the present invention.
Figure 2B:
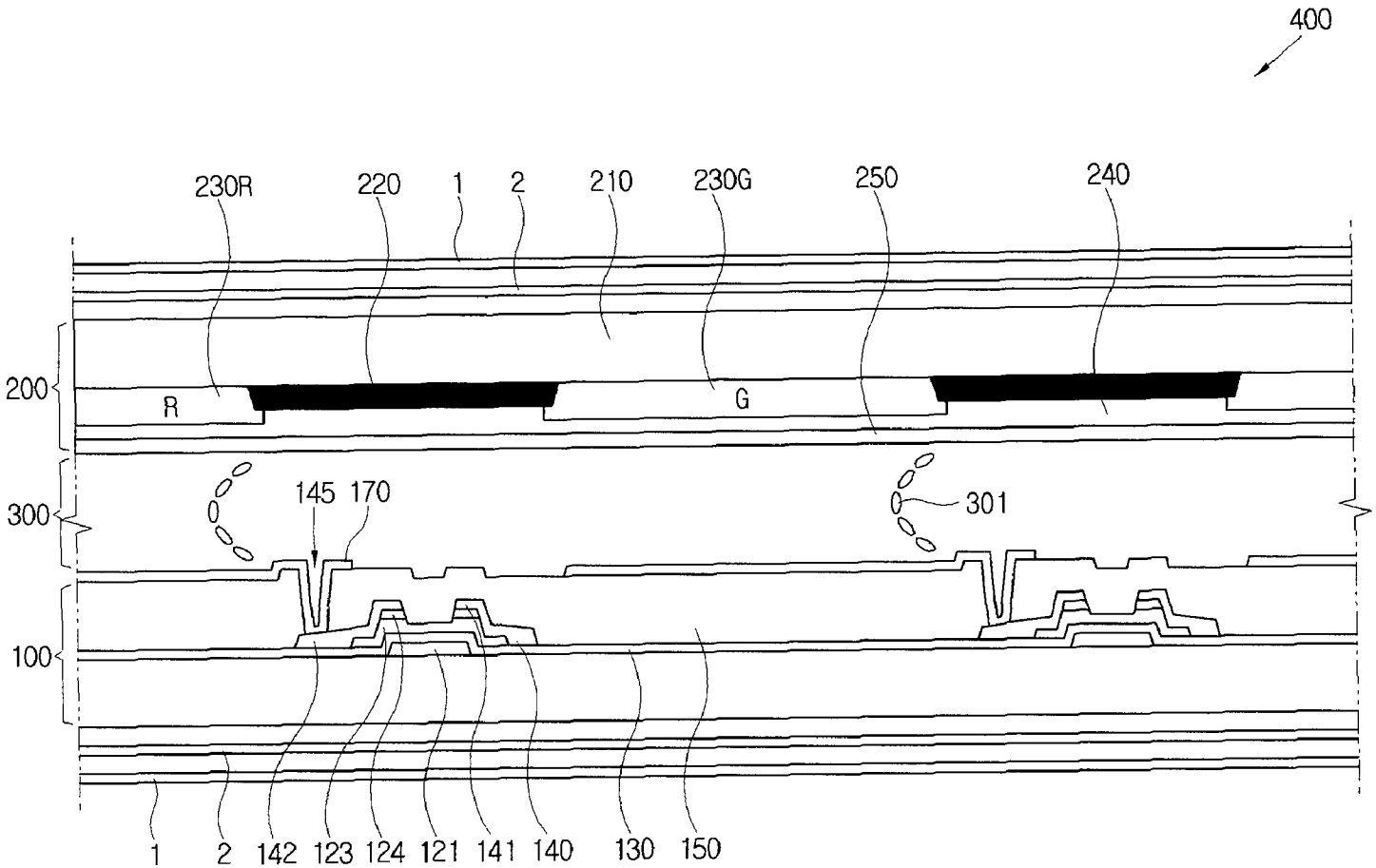
FIG. 2B is a sectional view of the display device according to the first embodiment of the present invention, taken along line II-II in FIG. 2A.

The liquid crystal panel 400 of the display device according to the first embodiment of the present invention will be described with reference to FIG. 2. FIG. 2A is a front view of the liquid crystal panel 400 of the display device according to the first embodiment of the present invention while FIG. 2B is a sectional view of the liquid crystal panel 400, taken along line II-II in FIG. 2A. The liquid crystal panel 400 includes a plurality of pixels A which has a thin film transistor and a pixel electrode as shown in FIG. 2A.

Gate wires 120, 121 and 122 are formed on a first insulating substrate 110. The gate wires 120, 121 and 122 may include a metal single or double layer. The gate wires 120, 121 and 122 include a gate line 120 which is elongated in a transverse direction, a gate electrode 121 which is connected with the gate line 120, a gate pad (not shown) which is connected with the gate driver (not shown) to receive a driving signal, And a maintenance electrode 122 formed on the same layer with the gate line 120 and the gate electrode 121 to store an electric charge.

A gate insulating layer 130 comprising silicon nitride (SiNx) covers the gate wires 120, 121 and 122 on the first insulating substrate 110.

A semiconductor layer 123 comprising semiconductor such as amorphous silicon is formed on the gate insulating layer 130 of the gate electrode 121 while an ohmic contact layer 124 comprising n+ hydrogenated amorphous silicon highly doped with silicide or an n-type dopant is formed on the semiconductor layer 123. The ohmic contact layer 124 is removed from a channel between a source electrode 142 and a drain electrode 141 which will be described later.

Data wires 140, 141, and 142 are formed on the ohmic contact layer 124 and the gate insulating layer 130. The data wires 140, 141 and 142 may also include a metal single or double layer. The data wires 140, 141 and 142 include a data line 140 which is provided in a vertical direction to cross the gate line 120 and forms the pixels A, the drain electrode 141 which is branched from the data line 140 and extends to an upper part of the ohmic contact layer 124, and the source electrode 142 which is separated from the drain electrode 141 and formed on the ohmic contact layer 124 opposite to the drain electrode 141.

A passivation layer 150 is formed on the data wires 140, 141, and 142 and the semiconductor layer 123 which is not covered by the data wires 140, 141, and 142. An inorganic insulating layer comprising silicon nitride may be formed between the passivation layer 150 and the thin film transistor to secure credibility of the thin film transistor.

A pixel electrode 170 is formed on the passivation layer 150 and includes a transparent conductive material such as indium tin oxide (ITO), indium zinc oxide (IZO), etc. The pixel electrode 170 is electrically connected with the source electrode 142 through a contact hole 145. A pixel electrode cutting pattern 171 is formed on the pixel electrode 170 to divide the pixel electrode 170 into a plurality of domains. The pixel electrode cutting pattern 171 divides a liquid crystal layer 300 into the plurality of domains together with a common electrode cutting pattern 251 which is formed on a common electrode 250, thereby improving a viewing angle.

Hereinafter, a second substrate 200 of the display device according to the first exemplary embodiment of the present invention will be described. A black matrix 220 is formed on a second insulating substrate 210 corresponding to the thin film transistor of the first substrate 100. The black matrixes 220 generally define red, green, and blue filters and prevent external light from being introduced to the thin film transistor. The black matrixes 220 typically include a photosensitive organic material added with a black pigment. The black pigment includes carbon black, titanium oxide, etc.

A color filter 230 includes red, green, and blue filters 230R, 230G, and 230B that are repeatedly formed between the black matrixes 220. The color filter 230 assigns color to light emitted from a backlight unit (not shown) and traveling the liquid crystal layer 300. The color filter 230 typically includes a photosensitive organic material.

An overcoat layer 240 is formed on the color filter 230 and the black matrixes 220 which are not covered by the color filter 230. The overcoat layer 240 makes the color filter 230 flat and protects the color filter 230. The overcoat layer 240 may include acrylic epoxy.

The common electrode 250 is formed on the overcoat layer 240. The common electrode 250 includes a transparent conductive material such as indium tin oxide (ITO), indium zinc oxide (IZO), etc. The common electrode 250 supplies a voltage to the liquid crystal layer 300, together with the pixel electrode 170 of the first substrate 100. The common electrode cutting pattern 251 is formed on the common electrode 250 to divide the liquid crystal layer 300 into predetermined domains together with the pixel electrode cutting pattern 171.

The liquid crystal layer 300 is disposed between the first and second substrates 100 and 200 which are sealed by a sealant (not shown). The liquid crystal layer 300 includes a plurality of liquid crystal molecules 301 whose alignment varies according to a supplied voltage. The liquid crystal molecules 301 according to the first exemplary embodiment of the present invention are aligned in an optically compensated birefringent (OCB) mode. That is, nematic liquid crystals are splay-aligned and then bend-aligned by receiving a predetermined voltage. Light transmissivity is controlled by adjusting the supplied voltage. The liquid crystal molecules 301 aligned in the OCB mode respond with high speed and realize a wide viewing angle, prompting active researches on an application thereof. The display device according to the first exemplary embodiment of the present invention forms a plurality of sub frames (to be described later) while a conventional display device forms a single frame. Thus, the display device having the liquid crystal layer 300 should respond with high speed. The liquid crystal molecules 301 aligned in the OCB mode may provide up to 3 ms to 4 ms of response speed and realize the present invention. If a liquid crystal display device has excellent response speed, it may include liquid crystal molecules in other modes, instead of OCB mode.

The display device according to the present invention further includes a compensation film 2 which is disposed on an outside surface of the first and second substrates 100 and 200 and a polarizing film 1 which is disposed on an outside surface of the compensation film 2. A polarizing axis of the polarizing film 1 is perpendicular to a polarization axis of the other polarizing film 1, and makes an angle of 45 degree or 135 degree with a rubbing direction of an alignment layer (not shown).

The compensation film 2 is adjusted so that a compensation property is optimized on with a green light as a reference.

Returning to FIG. 1, a method of processing an image signal according to the first exemplary embodiment of the present invention will be described.

The signal controller 10 receives the n+k bit first image signal corresponding to one frame from the outside and divides one frame into a plurality of sub frames. The signal controller 10 uses the upper k most significant bits of the first image signal to form a non-image signal and uses a remaining lower n bit to form a second image signal, thereby forming a plurality of sub frames having the non-image signal and the second image signal.

Figure 3:
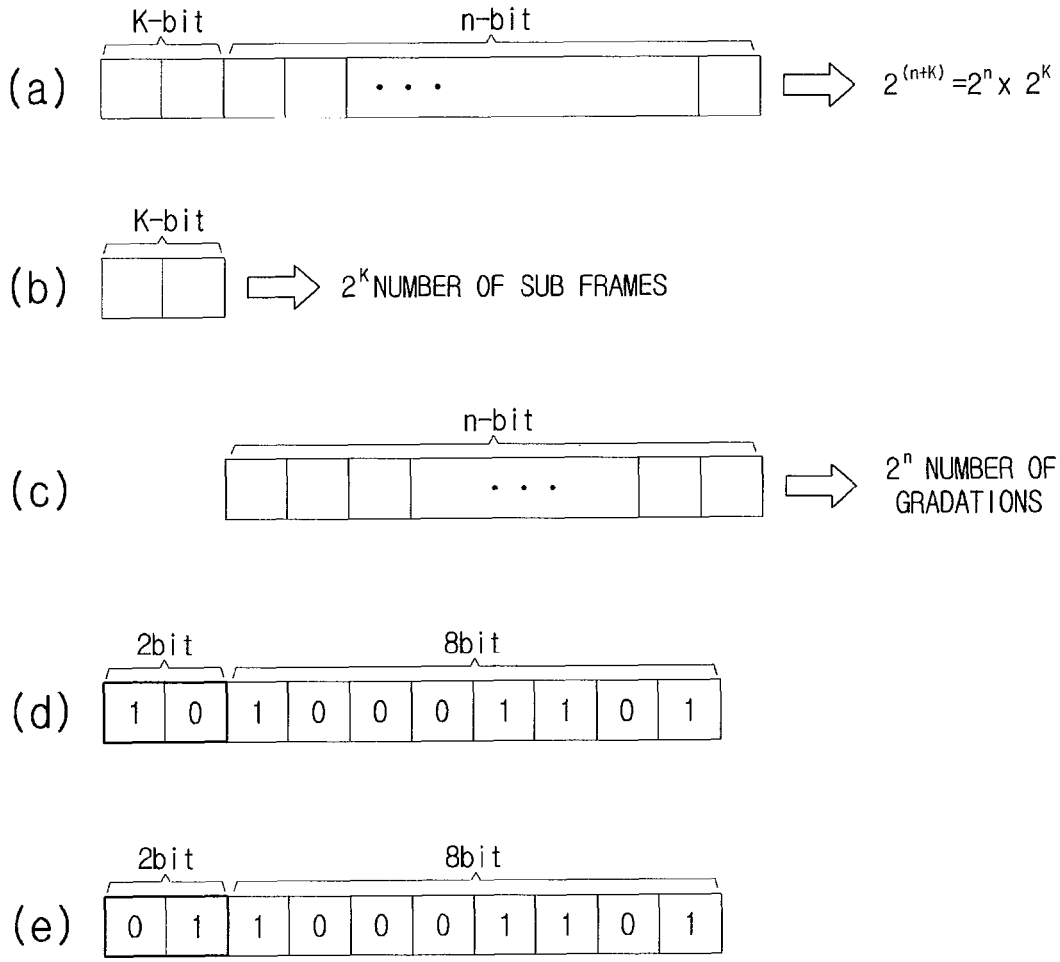
FIG. 3 illustrates bit variations of an image signal in the display device according to the first embodiment of the present invention.

FIG. 3 illustrates the number of bits of the image signal according to the present invention. As shown in (a) in FIG. 3, the first image signal inputted from the outside to the display device, i.e., to the signal controller 10 has the n+k bit. The display device divides red, green, and blue colors into a plurality of gradations respectively and combines the gradations to realize colors corresponding to an image. A single color is divided into many gradations, thereby raising a possibility of combining gradations. The number of gradations to colors is determined by the number of driving bits of the data driver 20.

If the data driver 20 is driven with the n bit, $2^n$ number of gradations may be expressed with respect to a single color. Thus, if the gradations of red, green and blue colors are combined, an image may be expressed with $2^{n*}2^{n*}2^n$ number of colors. For example, if the data driver 20 is driven with 10 bits, a single color is divided into $2^{10}$ number of colors, i.e., 1024 gradations to express zero to 1023 gradation levels. Overall, a single color can be expressed with $2^{10\times3}$ number of colors, i.e., 1073741824 colors.

Because the data driver 20 according to the first exemplary embodiment of the present invention is driven with the n bit, the signal controller 10 processes the n+k bit first image signal to the n bit second image signal and then, outputs to the data driver 20. The signal controller 10 uses a binary code of the upper k most significant bits of the n+k bit first image signal, to form an non-image signal sub frame expressing black or gray (c), and outputs the remaining n bit second image signal to the data driver 20 (b). Since the image signal outputted to the data driver 20 has the n bit to express $2^n$ number of gradations, the signal controller 10 forms $2^k$ number of sub frames having the non-image signal sub frame in respective pixels to compensate for the reduced gradations of the first image signal.

The $2^k$ number of sub frames that is formed by the signal controller 10 includes a non-image signal sub frame supplying a black or gray voltage to the pixels and a second image signal sub frame supplying a gradation voltage of the image signal. The number of non-image signal sub frames formed in the respective pixels may be identical or different. That is, $2^n$ number of gradations may be expressed by the data driver 20, and additional $2^k$ number of gradations may be expressed by adjusting a rate of the non-image signal in one frame or time for charging the gradation voltage to the pixels A. Thus, a user may acknowledge $2^{n+k}$ number of gradations as a result.

Typically, a display device forms 60 frames per second. That means, it takes 1/60 seconds to form a single frame. Time for turning on a single gate line 120 corresponds to 1/(60*the number of gate lines), and a single pixel A maintains a gradation voltage corresponding to a supplied image signal for 1/60 seconds, approximately 16 ms. In the first exemplary embodiment of the present invention, the charging time corresponding to about 16 ms may be adjusted depending on the respective pixels A to express $2^{n+k}$ number of gradations as a whole. More specifically, when a single pixel A is charged with a gradation voltage for both 16 ms and 8 ms, the gradation may be seen different even if the single pixel A receives the same gradation voltage. For example, as shown in (d) and (e) in FIG. 3, if most significant two bits are different and the remaining eight bits are the same in a 10-bit image signal, the pixel is formed with the second image signal sub frame representing the same gradation, and the number of the non-image signal sub frames receiving a black voltage is adjusted according to the upper two most significant bits of the binary code. If the display device includes a liquid crystal display device as the embodiment of the present invention, a moving image may be less blurred as an impulsive driving is possible with a black or gray voltage supplied to the non-image signal.

If k is 1, $2^1$ number of sub frames, i.e., two sub frames are formed and zero to one non-image signal sub frame can be formed. If k is 2, $2^2$ number of sub frames may be formed and zero to three non-image signal sub frames can be formed. To generalize what is mentioned above, if $2^k$ number of sub frames is formed, $2^k-1$ number of non-image signal sub frames may be formed. The greater the number of sub frames formed, the more different levels of gradation can be expressed. However, since the time for forming a plurality of sub frames is limited to that (about 16 ms) for forming a single frame, it is preferable but not necessary that the number of sub frames be properly set according to the response speed of the liquid crystal layer 300, driving power, etc.

FIGS. 4A to 4D illustrate the sub frames according to the first exemplary embodiment of the present invention.

The signal controller 10 uses the upper k most significant bits of the binary code to set the number of the non-image signal sub frames relating to the gradations of the image signal. The signal controller 10 adjusts the number of the non-image signal sub frames and the second image signal sub frames to control the charging rate of the gradation voltage in one frame. As shown therein, if the k bit image signal is (0 0), the overall sub frames are the second image signal sub frame (refer to FIG. 4A). If the k bit image signal is (1 1), the maximum number of non-image signal sub frames are formed (refer to FIG. 4D).

The gradations of an image signal may be differently realized according to the data drivers 20. In the first exemplary embodiment of the present invention, if a decimal value of the first image signal bit binary code is lower, the gradations of the image signal becomes higher. If the decimal value of the most significant bits of the binary code is lower, the number of the non-image signal sub frames decreases to express high gradation. That is, if the decimal value of the upper k most significant bits of the binary code is m, $2^k$–m number of second image signal sub frames and the m number of non-image signal sub frames are formed in one frame.

The data driver 20 generates a data voltage based on the non-image signal and the n bit second image signal inputted from the signal controller 10 and supplies them to the liquid crystal panel 400 for a single frame-forming time.

The signal controller 10 supplies information on the sub frames and a vertical synchronous signal to the gate driver 30, thereby allowing a plurality of sub frames to be formed in one frame. The gate driver 30 supplies a gate on/off signal to the gate line 120 according to the vertical synchronous signal inputted from the signal controller 10.

Figure 4A:
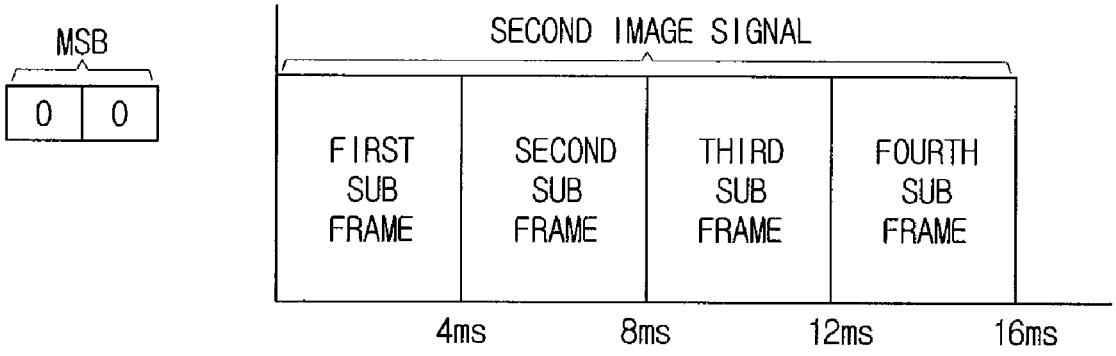
FIGS. 4A to 4D illustrate sub frames according to the first embodiment of the present invention.

If k is 2, a 2-bit digital signal may be represented as (0 0), (0 1), (1 0) and (1 1), which means four sub frames are formed for 16 ms. In this case, zero to three non-image signal sub frames may be formed. As described above, the number of the non-image signal sub frames is determined by the decimal value of the upper k most significant bits of the binary code. As shown in FIG. 4A, if the upper k most significant bits of the binary code is (0 0), the decimal value is 0. In this case, the non-image signal sub frame is not formed at all. The pixels A receive the same second image signal four times. That is, the second image signal is charged for 16 ms.

Figure 4B:
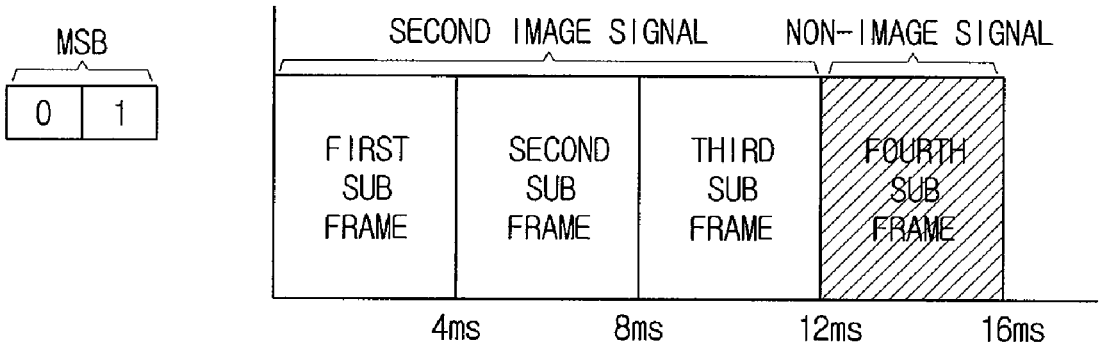

As shown in FIG. 4B, if the upper k most significant bits of the binary code is (0 1), the decimal value is 1. Thus, the non-image signal sub frame is formed as a last sub frame. During the first three frames, the concerned second image signal is supplied to be charged for 12 ms, and the non-image signal is supplied for the remaining 4 ms. As shown therein, the non-image signal sub frame among the four sub frames is formed lastly, i.e., after the second image signal sub frames. A liquid crystal display device employs an impulsive driving method to form a black image in one frame and prevent an image blur. The display device according to the first exemplary embodiment of the present invention forms the non-image signal sub frame for a single-frame forming time, thereby achieving the impulsive driving effect.

Figure 4C:
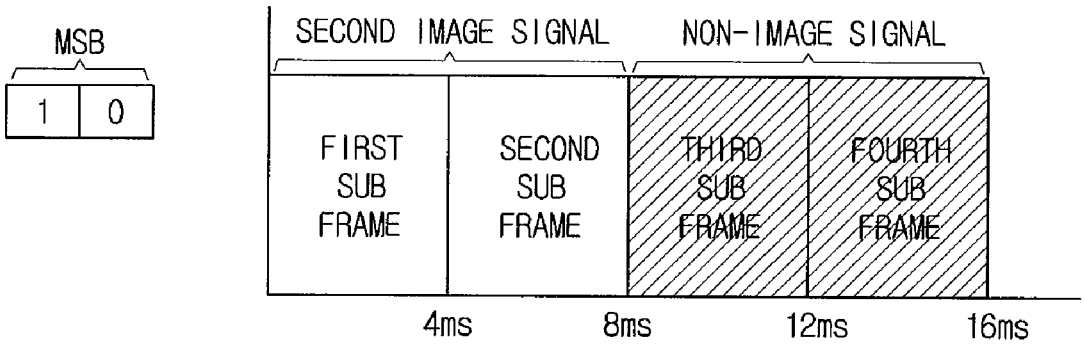

As shown in FIG. 4C, if the upper k most significant bits of the binary code is (1 0), the decimal value is 2. Thus, the pixel A is formed with two second image signal sub frames supplying the second image signal and two non-image signal sub frames supplying the non-image signal to charge the gradation voltage for 8 ms. The two non-image signal sub frames are consecutively formed at the end of the sub frames. It is preferable but not necessary that the non-image signal sub frames are consecutively formed to have a desired transmissivity by the second image signal supplied to the pixels.

Figure 4D:
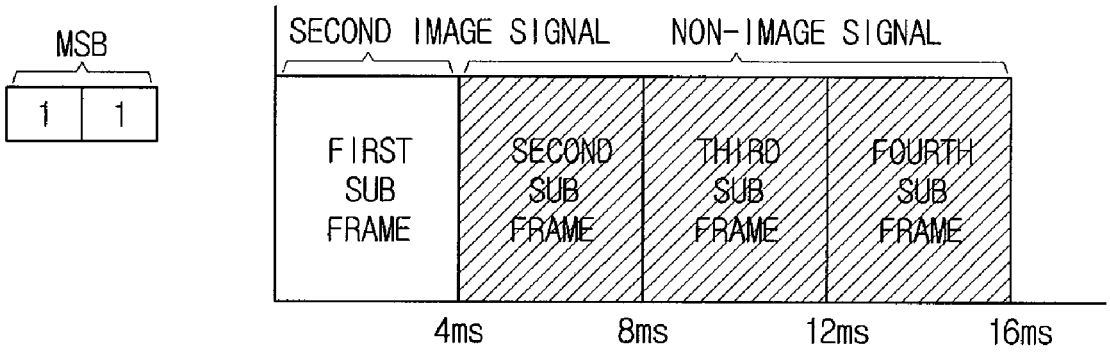
Figure 5A:
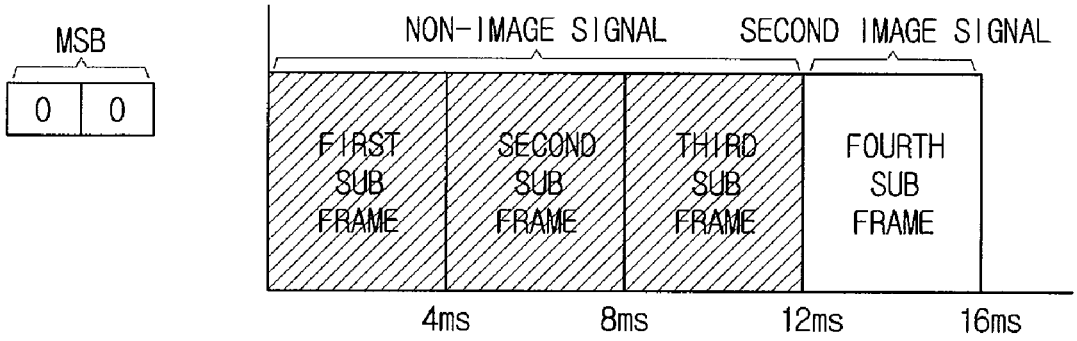
FIGS. 5A to 5D illustrate sub frames according to a second embodiment of the present invention.
Figure 5B:
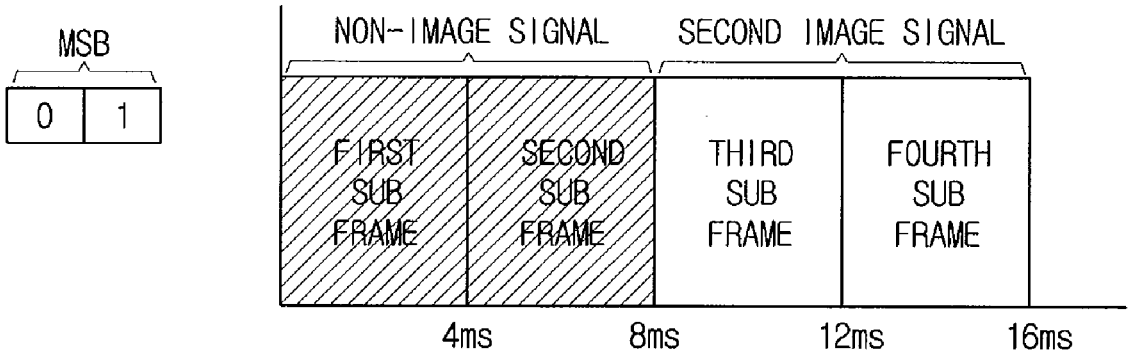
Figure 5C:
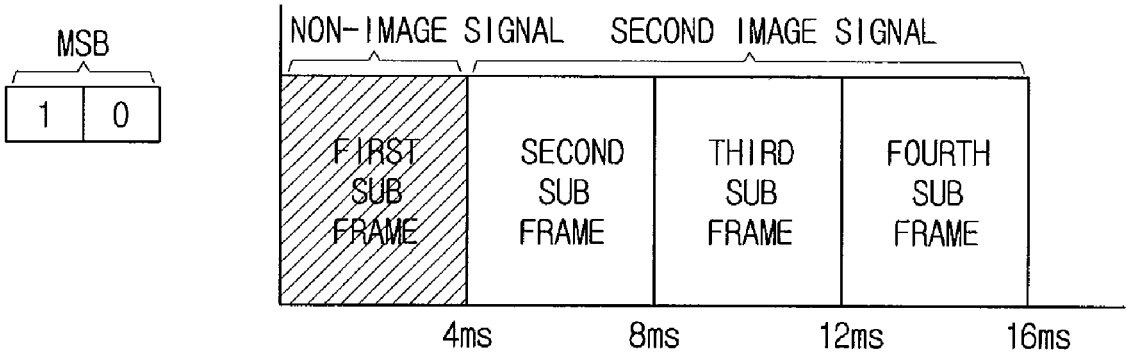
Figure 5D:
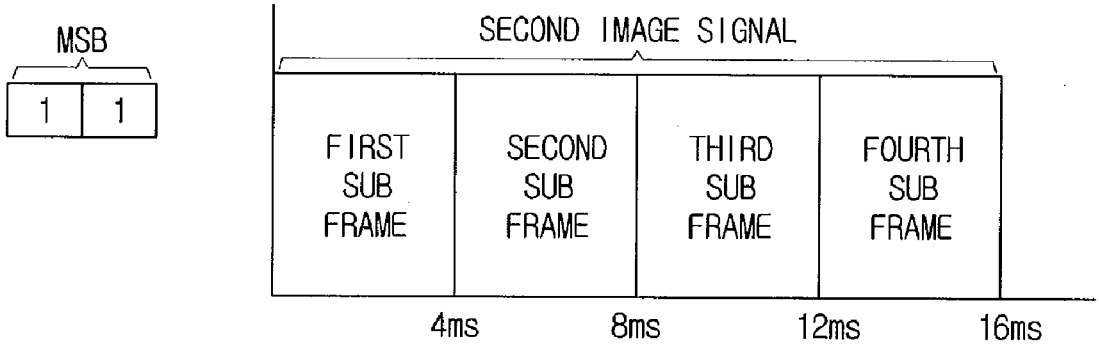

As shown in FIG. 4D, if the upper k most significant bits of the binary code is (1 1), the decimal value is 3. Thus, the first sub frame alone supplies the second image signal while the remaining three sub frames supply the non-image signal to the pixels A.

FIGS. 5A to 5D illustrates sub frames according to a second exemplary embodiment of the present invention. A process and method of forming a non-image signal sub frame according to the second embodiment is different from that according to the first embodiment.

In the second exemplary embodiment of the present invention, if the upper k most significant bits of the binary code is (0 0), the maximum number of non-image signal sub frames are formed. If the upper k most significant bits of the binary code is (1 1), the non-image signal sub frame is not formed. Contrary to the first embodiment, the larger the decimal value of the first image signal bit binary code is, the lower a gradation of an image signal is. That is, if the decimal value of the upper k most significant bits of the binary code is m, m+1 number of second image signal sub frames and $2^k$–(m+1) number of non-image signal sub frames are formed in one frame.

Thus, if the upper k most significant bits of the binary code is (0 0), three non-image signal sub frames are formed while one non-image signal sub frame is formed when the upper k most significant bits of the binary code is (1 0).

According to the second exemplary embodiment of the present invention, the non-image signal sub frame is formed before the second image signal sub frame while one frame is formed. A black image is also formed in one frame in the second exemplary embodiment which forms the non image signal sub frame prior to the second image signal sub frame, thereby achieving the impulsive driving effect.

Figure 6:
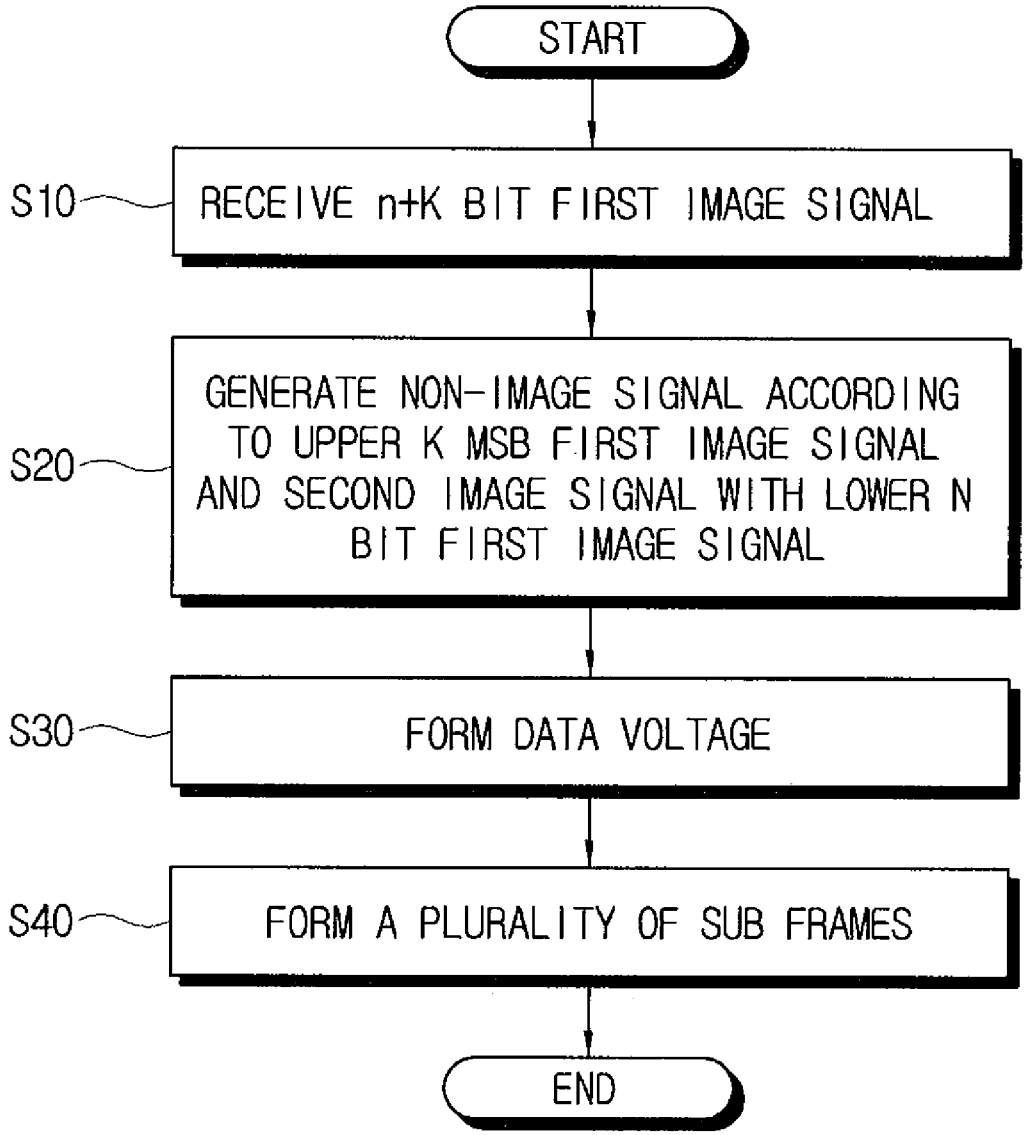
FIG. 6 is a control flowchart of the display device according to the first embodiment of the present invention.

FIG. 6 is a control flowchart of the display device according to the first exemplary embodiment of the present invention. The control method of the display device according to the second exemplary embodiment of the present invention is the same as that according to the first exemplary embodiment of the present invention, which will be described with reference to FIG. 6.

First, the signal controller 10 receives the n+k bit first image signal (S10).

Then, the signal controller 10 generates the non-image signal according to the upper k most significant bits of the binary code of the first image signal and the lower n bit second image signal in one frame with a predetermined rate (S20). Here, the rate of the non-image signal is determined by the decimal value of the image signal bit binary code.

The data driver 20 forms the data voltage based on the non-image signal and the second image signal (S30), and supplies the signals to the liquid crystal panel 400 to form the plurality of sub frames (S40).

In the present invention, a plurality of sub frames is formed to vary the charging time of the gradation voltage while one frame is formed. If the charging time of the gradation voltage is adjusted, the present invention is not limited to forming the sub frames, and may be realized by changing circuits and logic to drive the liquid crystal panel 400.

As described above, the present invention provides a display device which expresses $2^{n+K}$ number of gradations by using an n bit data driver, and a control method thereof.

Also, the present invention provides a display device which prevents an image blur by applying an impulsive driving, and a control method thereof.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A display device comprising:

a display panel comprising a plurality of pixels;

a signal controller which receives an n+k bit binary coded first image signal, divides one frame into $2^k$ sub frames, and generates a non-image signal from the upper k most significant bits of the binary code and a second image signal from the lower n bits in one frame with a predetermined rate; and a data driver which supplies the pixels with a data voltage selected on the basis of the non-image signal and the second image signal.

2. The display device according to claim 1, wherein the signal controller generates the second image signal in m+1 of the sub frames if the decimal value of the upper k most significant bits of the binary code is m.

3. The display device according to claim 2, wherein a sub frame displaying the non-image signal in one frame is formed prior to a sub frame displaying the second image signal.

4. The display device according to claim 2, wherein a sub frame displaying the second image signal in one frame is formed prior to a sub frame displaying the non-image signal.

5. The display device according to claim 2, wherein sub frames displaying the non-image signal are consecutively formed.

6. The display device according to claim 1, wherein the signal controller generates the second image signal in $2^k$–m number of sub frames if the decimal value of the upper k most significant bits of the binary code is m.

7. The display device according to claim 6, wherein a sub frame displaying the non-image signal in one frame is formed prior to the sub frame displaying the second image signal.

8. The display device according to claim 6, wherein the sub frame displaying the second image signal in one frame is formed prior to a sub frame displaying the non-image signal.

9. The display device according to claim 6, wherein sub frames displaying the non-image signal are consecutively formed.

10. The display device according to claim 1, wherein the sub frame displaying the non-image signal is represented in black in the display panel.

11. The display device according to claim 1, wherein the sub frame displaying the non-image signal is represented in gray in the display panel.

12. The display device according to claim 1, wherein 60 frames are formed per second.

13. The display device according to claim 1, wherein the display panel further comprises a first substrate, a second substrate and a liquid crystal layer disposed between the first and second substrates, the liquid crystal layer comprising liquid crystal molecules aligned in an optically compensated birefringent (OCB) mode.

14. A method of controlling a display device, comprising:

receiving an n+k bit first image signal in one frame;

dividing one frame into $2^k$ sub frames and generating a non-image signal formed according to the upper k most significant bits of the binary code in the first image signal and a second image signal from the lower n bits of the first image signal in one frame with a predetermined rate;

forming a data voltage based on the non-image signal and the second image signal; and forming a plurality of the sub frames in one frame by supplying the data voltage.

15. The method according to claim 14, wherein the forming of the sub frames comprises generating the second image signal in m+1 number of the sub frames if the decimal value of the upper k most significant bits of the binary code is m.

16. The method according to claim 15, wherein the forming of the sub frames comprises forming a sub frame displaying the non-image signal in one frame prior to a sub frame displaying the second image signal.

17. The method according to claim 15, wherein the forming of the sub frames comprises forming a sub frame displaying the second image signal in one frame prior to a sub frame displaying the non-image signal.

18. The method according to claim 15, wherein the forming of the sub frames comprises forming sub frames displaying the non-image signal consecutively.

19. The method according to claim 14, wherein the forming of the sub frames comprises generating the second image signal in $2^k$–m number of the sub frames if the decimal value of the upper k most significant bits of the binary code is m.

20. The method according to claim 14, wherein the sub frame displaying the non-image signal is represented in black or gray in the display panel.

21. The method according to claim 14, wherein 60 frames are formed per second.

* * * * *